US008637782B2

(12) United States Patent
Ishikawa

(10) Patent No.: US 8,637,782 B2
(45) Date of Patent: Jan. 28, 2014

(54) SWITCH UNIT AND ELECTRONIC DEVICE INCLUDING SWITCH UNIT

(75) Inventor: Koji Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 13/297,923

(22) Filed: Nov. 16, 2011

(65) Prior Publication Data

US 2012/0145525 A1 Jun. 14, 2012

(30) Foreign Application Priority Data

Dec. 9, 2010 (JP) ..... 2010-275143

(51) Int. Cl.
*H01H 1/10* (2006.01)

(52) U.S. Cl.
USPC ..... 200/512; 200/305

(58) Field of Classification Search
USPC ..... 200/512, 516, 305, 306
See application file for complete search history.

(56) References Cited

U.S. PATENT DOCUMENTS 6,617,536 B2 * 9/2003 Kawaguchi ..... 200/516
6,946,611 B2 * 9/2005 Yoneyama ..... 200/515
8,507,820 B2 * 8/2013 Chen et al. ..... 200/515

FOREIGN PATENT DOCUMENTS

JP 2003-347699 A 12/2003
JP 2010-192199 A 9/2010

* cited by examiner

*Primary Examiner* — Xuong Chung Trans
(74) *Attorney, Agent, or Firm* — Canon USA, Inc., IP Division

(57) ABSTRACT

A printed wiring board has a first switch contact pattern, a second switch contact pattern, and a cutting portion that cuts a plating bar formed thereon. A metal dome is arranged to be in contact with the first switch contact pattern and allows the first switch contact pattern and the second switch contact pattern to be conductive by being deformed. A first sheet attached to the printed wiring board via an adhesive has a first opening portion formed in a region where the metal dome is arranged and a second opening portion formed in the region where a cutting portion is formed. A second sheet is attached to the first sheet via the adhesive to cover the first opening portion and the second opening portion.

8 Claims, 9 Drawing Sheets

SWITCH UNIT AND ELECTRONIC DEVICE INCLUDING SWITCH UNIT

BACKGROUND OF THE INVENTION

1. Field of the Invention

The present invention relates to a switch unit and an electronic device including the switch unit.

2. Description of the Related Art

A sheet switch in which a metal dome is arranged on a printed wiring board and a sheet is attached thereto is known as discussed in Japanese Patent Application Laid-Open No. 2010-192199. A contact pattern formed on the printed wiring board is surface-treated with electrolytic gold plating to secure stable contact reliability with the metal dome. In this case, the printed wiring board needs a pattern called a plating bar connected up to an outline end of the board to surface-treat the contact pattern with electrolytic gold plating at the time of manufacture as discussed in Japanese Patent Application Laid-Open No. 2003-347699.

However, in some cases, it is difficult to pull out the pattern to be plated up to the outline end. In such a case, other patterns whose plating bar is pulled out to the outline end and the pattern whose plating bar cannot be pulled out to the outline end are connected inside the board and after plating is performed, the connection portion of mutual patterns are drilled to disconnect the mutual patterns.

If the plating bar disconnection hole is present in an attachment portion of the sheet switch, the plating bar exposed to an end face of the plating bar disconnection hole and an adhesive of the sheet switch may come into contact.

If an electronic device is used in a very humid environment, patterns disconnected by the plating bar disconnection hole may be allowed to be conductive due to moisture absorption of the adhesive, leading to a malfunction of the device. To avoid such a malfunction, forming an opening in the sheet switch so as not to cover the plating bar disconnection hole can be considered. In this case, however, patterns are exposed from the end face of the plating bar disconnection hole. Thus, if static electricity passes through a gap between an exterior cover of the electronic device and the key top of the switch, the static electricity that has passed flows from the end face to the exposed pattern, causing an issue of a malfunction of the electronic device.

In consideration of the above point, it is necessary to position the plating bar disconnection hole sufficiently remotely from the gap between the exterior cover and the key top, but sufficient measures may not be executable due to miniaturization of an electronic device or for the convenience of wiring of a printed wiring board.

SUMMARY OF THE INVENTION

The present invention is directed to a switch unit that does not allow a pattern in a plating bar disconnection portion to be conduction state and also prevents static electricity from passing through the plating bar disconnection portion even if an electronic device is used in a very humid environment.

According to an aspect of the present invention, a switch unit includes a printed wiring board on which a first switch contact pattern, a second switch contact pattern, and a cutting portion that cuts a plating bar are formed, a metal dome arranged to be in contact with the first switch contact pattern, the metal dome allowing the first switch contact pattern and the second switch contact pattern to be conduction state by being deformed, a first sheet member attached to the printed wiring board via an adhesive, the first sheet member having insulation properties and having a first opening portion formed in a region where the metal dome is arranged and a second opening portion formed in the region where the cutting portion is formed, and a second sheet member attached to the first sheet member via the adhesive, the second sheet member having the insulation properties and being attached to the first sheet member to cover the first opening portion and the second opening portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

The first exemplary embodiment will be described. An exemplary embodiment of the present invention will be described in detail below based on appended drawings.

Figure 1A:
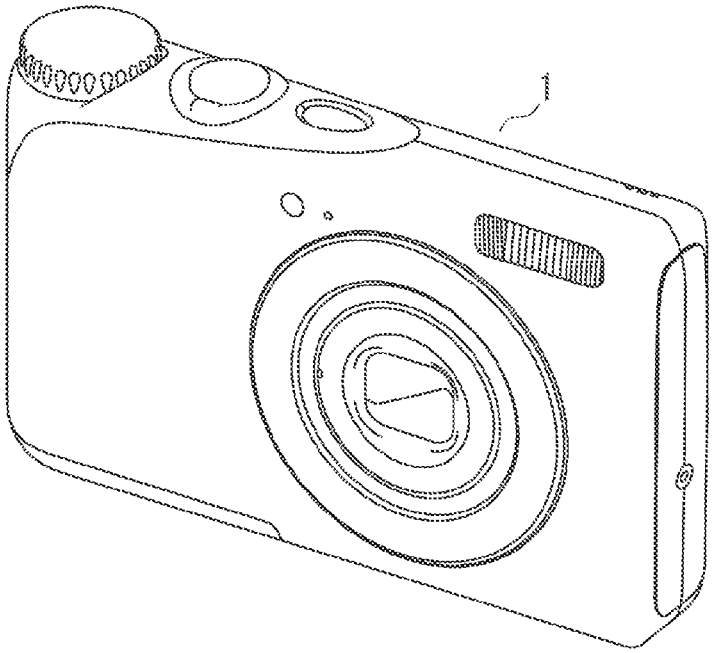
FIGS. 1A and 1B are external perspective views of a digital camera, which is an example of an electronic device including a switch unit according to a first exemplary embodiment.
Figure 1B:
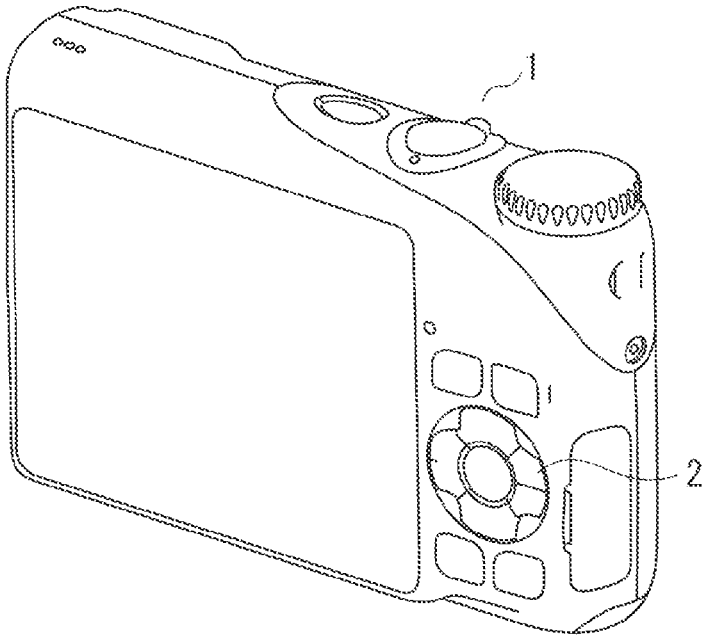

FIGS. 1A and 1B are external perspective views of a digital camera as an example of an electronic device including a switch unit embodying the present invention. FIG. 1A is an external perspective view viewed from the front side and FIG. 1B is an external perspective view viewed from the rear side. A digital camera 1 in the present exemplary embodiment has operation buttons 2 to operate the camera and make various settings arranged on the rear side.

Figure 2:
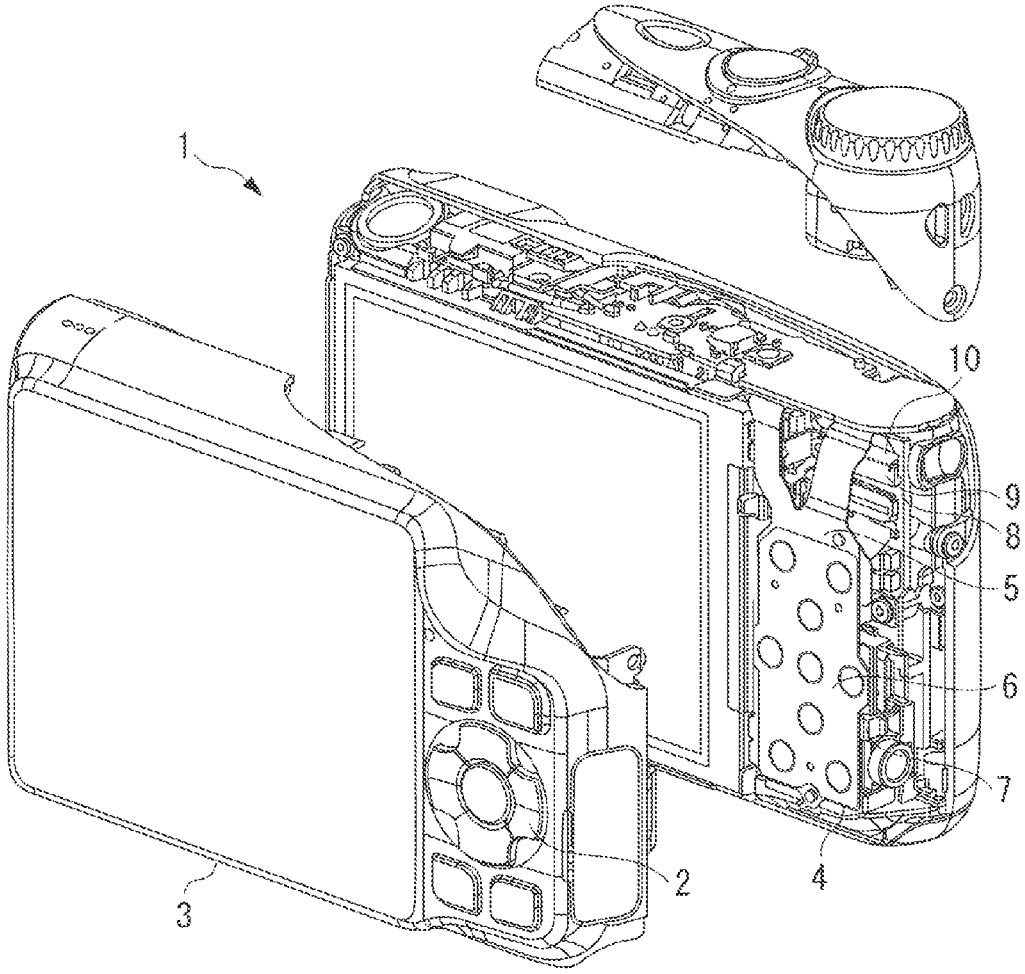
FIG. 2 is an exploded perspective view illustrating an internal constitution on the side of rear operation buttons of the digital camera.

FIG. 2 is an exploded perspective view illustrating an internal constitution on the side of rear operation buttons of the digital camera 1 of FIGS. 1A and 1B.

A rear cover 3 has the operation buttons 2 set in a predetermined position. A switch unit 4 having switches in positions corresponding to the operation buttons 2 of the rear cover 3 is arranged inside the camera. The switch unit 4 is constituted by attaching a sheet switch 6 to a flexible printed wiring board 5. The switch unit 4 is attached and fixed to a main chassis 7 on the side of a camera body and is connected to a main board 8 to control the camera. The switch unit 4 is connected to the main board 8 by a connector terminal portion 10 provided on the flexible printed wiring board 5 and a connector 9 mounted on the main body 8 being connected.

Figure 3A:
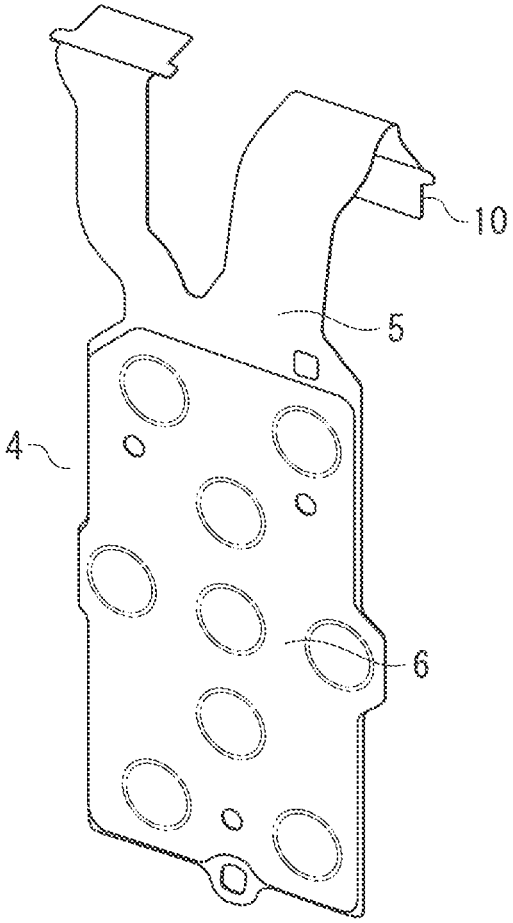
FIGS. 3A and 3B are perspective views of the switch unit.
Figure 3B:
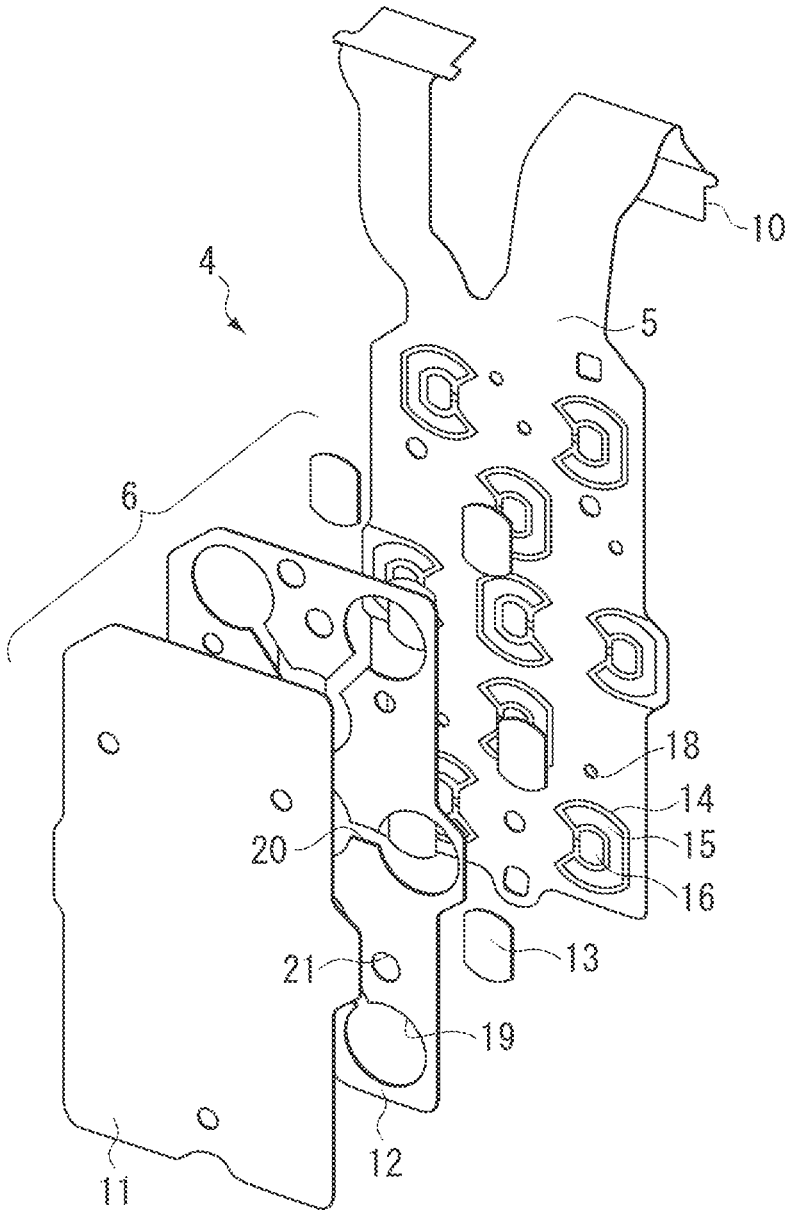

Next, a detailed configuration of the switch unit 4 will be described using FIGS. 3A and 3B. FIG. 3A is a perspective view of the switch unit 4 in a state in which the sheet switch 6 is attached to the flexible printed wiring board 5 and FIG. 3B is an exploded perspective view thereof.

The sheet switch 6 includes an outer sheet 11, a spacer sheet 12, and a metal dome 13. The outer sheet 11 functions as a second sheet member and the spacer sheet 12 functions as a first sheet member.

The outer sheet 11 and the spacer sheet 12 are sheets made of resin having insulation properties and each have an adhesive layer formed on the side facing the flexible printed wiring board 5. The metal dome 13 is a stainless spring in a dome shape and operates in such a way that a vertex portion thereof is deformed when a center portion thereof is pressed and the vertex portion is restored when pressing is released.

The flexible printed wiring board 5 has a switch contact pattern formed in a position corresponding to the metal dome 13. The switch contact pattern is formed in such a way that copper foil of a conductive layer is exposed from an opening portion 14 formed by opening a cover lay, which is an insulating layer on the surface of the flexible printed wiring board 5. The switch contact pattern is an outer contact pattern 15 functioning as a first switch contact pattern and an inner contact pattern 16 functioning as a second switch contact pattern. The metal dome 13 is arranged on the flexible printed wiring board 5 so that an outer circumferential portion of the metal dome 13 is in contact with the outer contact pattern 15.

In a normal state in which the switch is not pressed, the outer circumferential portion of the metal dome 13 is in contact with the outer contact pattern 15 and the vertex portion of the metal dome 13 is not in contact with the inner contact pattern 16, so that the outer contact pattern 15 and the inner contact pattern 16 are not in conduction state. In a state in which the switch is pressed and the vertex portion of the metal dome 13 is deformed, the outer circumferential portion of the metal dome 13 is in contact with the outer contact pattern 15 and also the vertex portion of the metal dome 13 is in contact with the inner contact pattern 16. Accordingly, the outer contact pattern 15 and the inner contact pattern 16 become conduction state. A camera control integrated circuit (IC) mounted on the main board 8 detects the conduction or non-conduction to function as a switch.

The surface of the outer contact pattern 15 and the inner contact pattern 16 is surface-treated with electrolytic gold plating to secure stable contact reliability with the metal dome 13. The flexible printed wiring board 5 has a pattern called a plating bar connected to the end of a board outline to treat a contact pattern with electrolytic gold plating at the time of manufacture.

The plating bar of the flexible printed wiring board 5 will be described below.

Figure 4A:
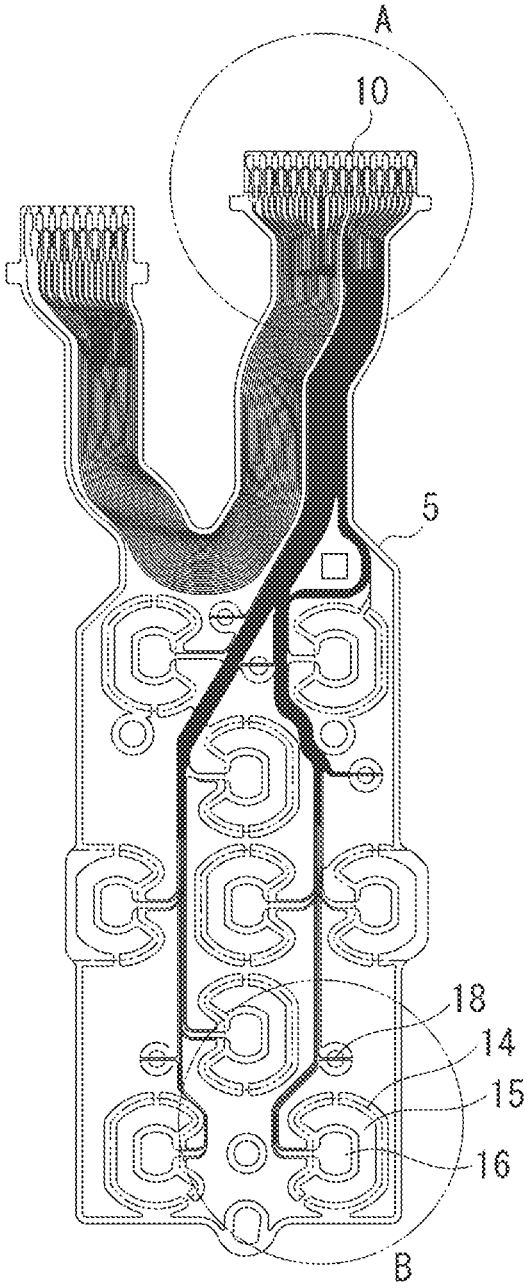
FIGS. 4A, 4B, and 4C are diagrams illustrating a pattern wiring of a flexible printed wiring board.
Figure 4B:
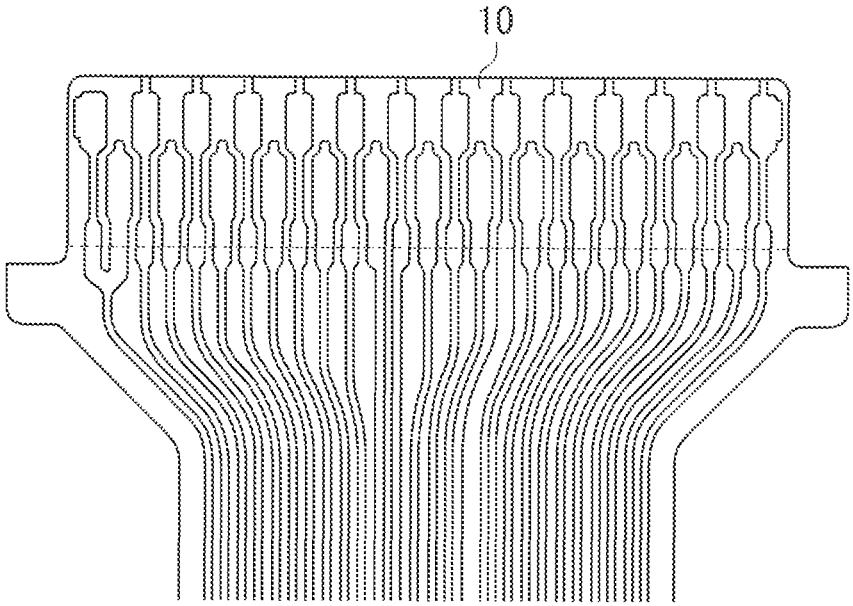
Figure 4C:
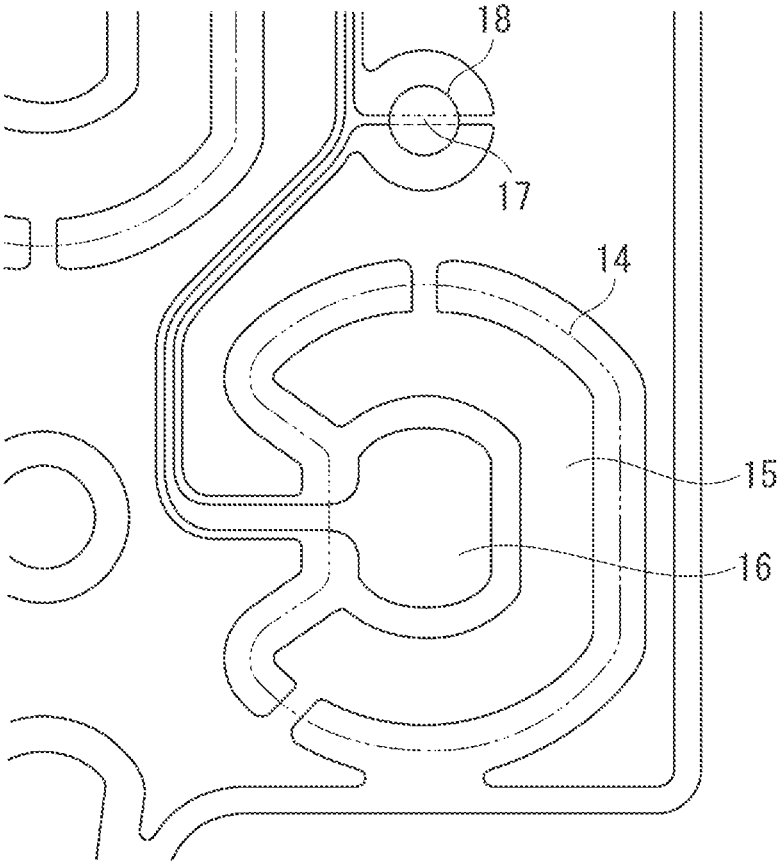

FIG. 4A is a pattern wiring diagram of the flexible printed wiring board 5. FIG. 4B is an A portion enlarged view of FIG. 4A and FIG. 4C is a B portion enlarged view of FIG. 4A.

A portion of plating bars of a plurality of electrolytic gold plated portions present in the flexible printed wiring board 5 is formed, as illustrated in FIG. 4B, at the tip of the connector terminal portion 10. The connector terminal portion 10 has contact pads for contact with connectors of the connected main board 8 in staggered arrangement, so that a plating bar can be pulled out from the pad on the tip side to the outline end of the connector terminal portion 10. However, when a plating bar is formed from an inner pad to the outline end of the connector terminal portion 10, it is necessary to form the plating bar passing between pads on the tip side as a very thin pattern.

If a very thin pattern is formed between pads on the tip side, the pattern may be peeled when a connector is inserted, so that there is a fear that the peeled pattern causes a short-circuit between adjacent patterns. Thus, it is not useful to form a plating bar with a very thin pattern to pass between pads on the tip side. Therefore, as illustrated in FIG. 4C, patterns capable of forming a plating bar to the outline end and patterns incapable of forming a plating bar to the outline end are connected by a connection portion 17 formed on the board. In this state, the connection portion 17 is disconnected by treating the pattern with electrolytic gold plating and, after the electrolytic gold plating, forming a plating bar disconnection hole 18 as a disconnection portion. Therefore, sections of patterns are exposed at the section of the plating bar disconnection hole 18.

Returning to FIGS. 3A and 3B, the spacer sheet 12 will be described. The spacer sheet 12 has insulation properties and is attached to the flexible printed wiring board 5 via an adhesive. The spacer sheet 12 has a first opening portion 19 formed in a region where the metal dome 13 is arranged.

The outer sheet 11 is attached to the spacer sheet 12 via an adhesive and thus, the spacer sheet 12 is positioned between the flexible printed wiring board 5 and the outer sheet 11. Therefore, with the first opening portion 19 formed in the spacer sheet 12, a space to arrange the metal dome 13 is formed between the flexible printed wiring board 5 and the outer sheet 11.

If the spacer sheet 12 is not present and the outer sheet 11 is directly attached to the flexible printed wiring board 5, the outer sheet 11 is attached to the flexible printed wiring board 5 with a step corresponding to the height of the metal dome 13. Thus, particularly if the metal dome 13 is arranged in a position close to the outline end of the outer sheet 11, the end face of the outer sheet 11 is more likely to peel.

In addition, there is a danger that dust or dirt penetrates into the metal dome 13 through a gap of the end face of the peeled outer sheet 11 to cause a contact failure. On the other hand, with the spacer sheet 12 being provided between the outer sheet 11 and the flexible printed wiring board 5, the outer sheet 11 can be attached in a step smaller than the height of the metal dome 13. Therefore, even if the metal dome 13 is arranged in a position close to the outline end face of the outer sheet 11, the end face of the outer sheet 11 is less likely to peel and no dust or dirt will penetrate into the metal dome 13 through the end face of the peeled sheet.

The spacer sheet 12 has a slit 20 to connect the respective first opening portions 19. The slit 20 plays the role of a vent hole through which the air pressed out from inside the metal dome 13 passes when the switch is pressed and the metal dome 13 is deformed. If the slit 20 is not formed, the air pressed out from inside the metal dome 13 cannot escape from the space of the first opening portion 19 and is compressed, affecting the touch of the switch. With the spacer sheet 12 in which the slit 20 is formed being provided between the outer sheet 11 and the flexible printed wiring board 5, a satisfactory switch touch can be obtained.

Further, the spacer sheet 12 has a second opening portion 21 formed in a portion overlapping with the plating bar disconnection hole 18 of the flexible printed wiring board 5. Therefore, the plating bar disconnection hole 18 is exposed from the second opening portion 21 even if the spacer sheet 12 is attached to the flexible printed wiring board 5.

Figure 5:
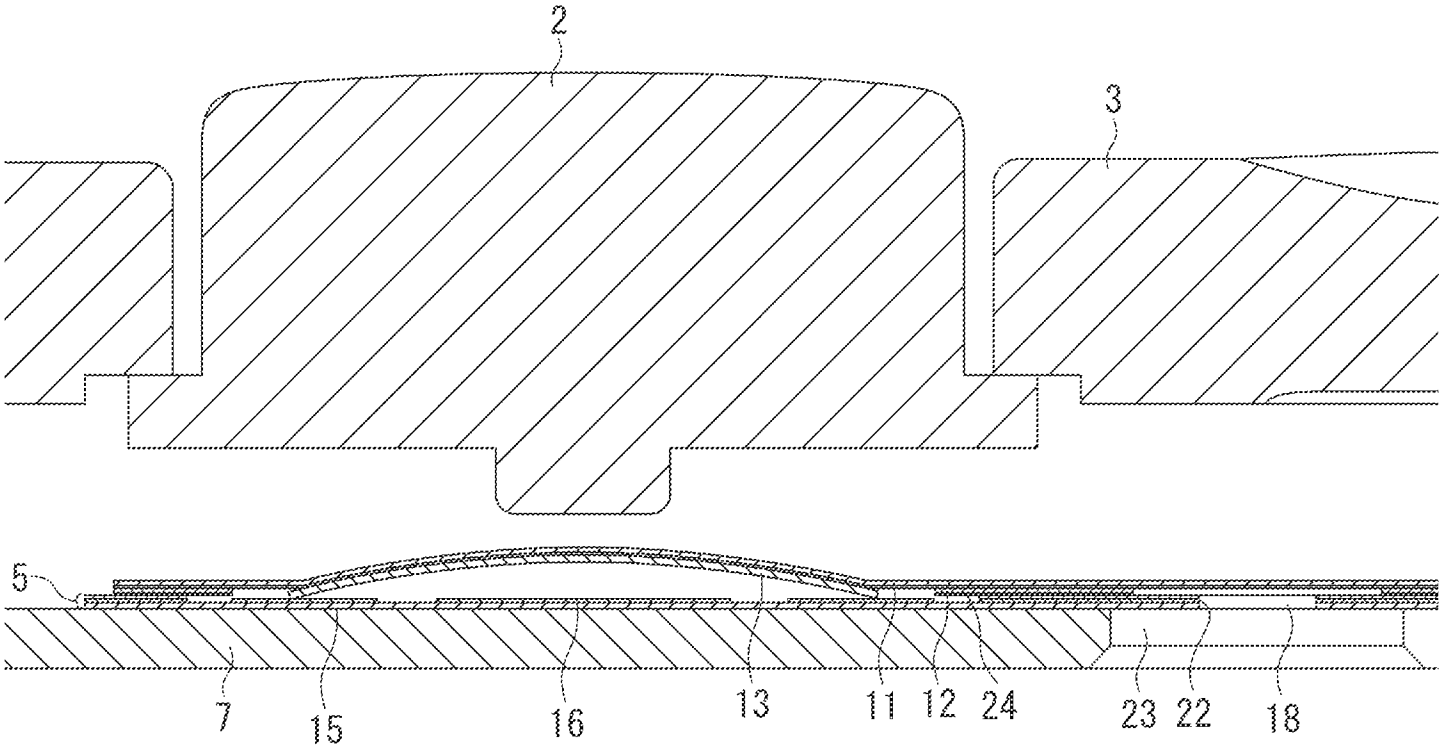
FIG. 5 is a sectional schematic diagram of the switch unit.

This portion will be described using FIG. 5. FIG. 5 is a sectional schematic diagram passing through the center of the plating bar disconnection hole 18 and the operation buttons 2 of the switch unit 4 and the operation buttons 2 in a camera state.

An end face pattern exposure portion 22, which is a section of pattern disconnected by the hole, is exposed at the end face of the plating bar disconnection hole 18.

The main chassis 7 has a through hole 23 provided in a position corresponding to the plating bar disconnection hole 18 to prevent the end face pattern exposure portion 22 from being conduction state.

The spacer sheet 12 is provided with the second opening portion 21 and thus, an adhesive layer 24 of the spacer sheet 12 and the end face pattern exposure portion 22 do not come into contact.

Even if an electronic device is used in a very humid environment and sufficient insulation properties cannot be maintained after the adhesive layer 24 absorbs moisture, the adhesive layer 24 does not allow the end face pattern exposure portion 22 to be conduction state.

The outer sheet 11 has insulation properties and is attached to the spacer sheet 12 and the metal dome 13 via an adhesive. The surface of the metal dome 13 is covered with the outer sheet 11 by the outer sheet 11 being attached to the spacer sheet 12. Further, the first opening portion 19 and the second opening portion 21 of the spacer sheet 12 are covered by the outer sheet 11 being attached to the spacer sheet 12. In other words, the plating bar disconnection hole 18 is sealed off from the side of the operation buttons 2. Accordingly, even if static electricity passes through a gap between the operation buttons 2 and the rear cover 3, the static electricity that has passed does not flow to the end face pattern exposure portion 22.

If an electronic device is used in a very humid environment, sufficient insulation properties cannot be maintained because the adhesive layer of the outer sheet 11 also absorbs moisture. However, the spacer sheet 12 is provided between the outer sheet 11 and the flexible printed wiring board 5 and thus, the adhesive layer of the outer sheet 11 will not come into contact with the end face pattern exposure portion 22 of the plating bar disconnection hole 18.

According to the first exemplary embodiment, as described above, the adhesive layer 24 does not allow the end face pattern exposure portion 22 to be conduction state even if the adhesive layer 24 absorbs moisture. Moreover, the plating bar disconnection hole 18 is covered with the outer sheet 11 and therefore, there is no restriction on the position where a plating bar disconnection hole is provided.

The first exemplary embodiment is configured so that even if the adhesive layer 24 absorbs moisture, the adhesive layer 24 does not allow the end face pattern exposure portion 22 to be conduction state by forming the second opening portion 21 in the spacer sheet 12. Instead, a similar operation/working-effect can also be achieved by forming the plating bar disconnection hole 18 of the flexible printed wiring board 5 in a position corresponding to the slit 20 of the spacer sheet 12 without forming the second opening portion 21.

The second exemplary embodiment will be described. The configuration of a switch unit 104 according to the second exemplary embodiment will be described using FIG. 6. In the first exemplary embodiment, the metal dome 13 is arranged on the flexible printed wiring board 5 and the spacer sheet 12 and the outer sheet 11 are attached. In the second exemplary embodiment, by contrast, the metal dome 13 is arranged on the flexible printed wiring board 5 and an outer sheet 111 is attached to the flexible printed wiring board 5 and the metal dome 13 by a double-faced adhesive member. The outer sheet 111 functions as a sheet member.

Figure 6:
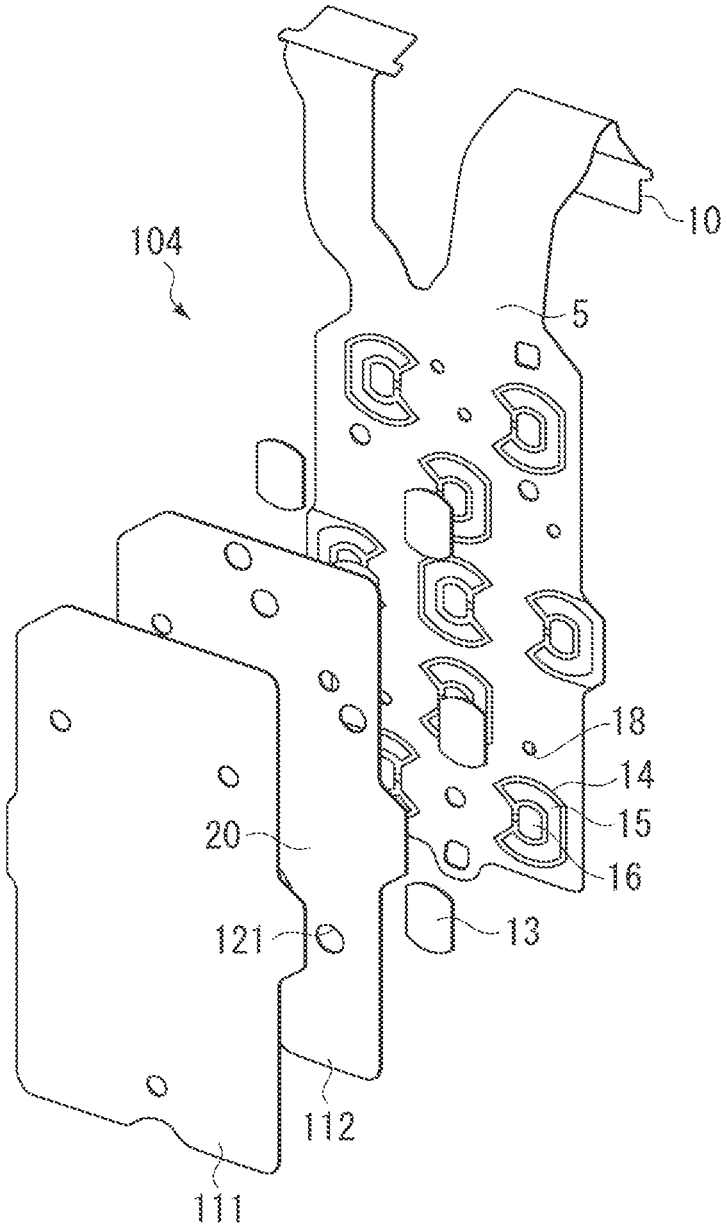
FIG. 6 is a perspective view of a switch unit according to a second exemplary embodiment.

FIG. 6 is an exploded perspective view illustrating the configuration of the switch unit 104.

The flexible printed wiring board 5 and the metal dome 13 are similar to the first exemplary embodiment and thus, a description thereof is not repeated. A double-faced adhesive member 112 is positioned between the flexible printed wiring board 5 on which the metal dome 13 is arranged and the outer sheet 111 and is a pressure sensitive adhesive double coated tape which attaches the outer sheet 111 to the flexible printed wiring board 5. The double-faced adhesive member 112 has insulation properties, but cannot maintain sufficient insulation properties after absorbing moisture.

The double-faced adhesive member 112 has an opening portion 121 formed in a portion overlapping with the plating bar disconnection hole 18 of the flexible printed wiring board 5. Therefore, even if the flexible printed wiring board 5 on which the metal dome 13 is arranged is attached to one side of the double-faced adhesive member 112, the plating bar disconnection hole 18 is exposed from the opening portion 121 and double-faced adhesive member 112 will not cover the plating bar disconnection hole 18. When the flexible printed wiring board 5 on which the metal dome 13 is arranged is attached to one side of the double-faced adhesive member 112, the double-faced adhesive member 112 is also attached to the surface of the metal dome 13.

Then, the outer sheet 111 is attached to the other side of the double-faced adhesive member 112. Accordingly, the outer sheet 111 covers the opening portion 121 and the plating bar disconnection hole 18 is sealed off from the side of the operation buttons 2. Accordingly, even if static electricity passes through a gap between the operation buttons 2 and the rear cover 3, the static electricity that has passed does not flow to the end face pattern exposure portion 22.

The outer sheet 111 is formed of a material having insulation properties and the insulation properties do not change after moisture absorption. Therefore, even if the double-faced adhesive member 112 cannot maintain sufficient insulation properties after absorbing moisture, the adhesive layer 24 does not allow the end face pattern exposure portion 22 to be conduction state.

According to the second exemplary embodiment, as described above, the double-faced adhesive member 112 does not allow the end face pattern exposure portion 22 to be conduction state even if the double-faced adhesive member 112 absorbs moisture. Moreover, the plating bar disconnection hole 18 is covered with the outer sheet 111 and therefore, there is no restriction on the position where a plating bar disconnection hole is provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-275143 filed Dec. 9, 2010, which is hereby incorporated by reference herein in its entirety.

What is claimed is:

1. A switch unit comprising:

a printed wiring board on which a first switch contact pattern, a second switch contact pattern, and a cutting portion that cuts a plating bar are formed;

a metal dome configured to be arranged in contact with the first switch contact pattern, the metal dome allowing the first switch contact pattern and the second switch contact pattern to be conduction state by being deformed;

a first sheet member configured to be attached to the printed wiring board via an adhesive, the first sheet member having insulation properties and having a first opening portion formed in a region where the metal dome is arranged and a second opening portion formed in a region where the cutting portion is formed; and a second sheet member configured to be attached to the first sheet member via the adhesive, the second sheet member having the insulation properties and being attached to the first sheet member to cover the first opening portion and the second opening portion.

2. The switch unit according to claim 1, wherein the plating bar is configured to be formed to connect the first switch contact pattern and the second switch contact pattern.

3. A switch unit comprising:

a printed wiring board on which a first switch contact pattern, a second switch contact pattern, and a cutting portion that cuts a plating bar are formed;

a metal dome configured to be arranged in contact with the first switch contact pattern, the metal dome allowing the first switch contact pattern and the second switch contact pattern to be conduction state by being deformed;

a sheet member configured to be attached to the printed wiring board on which the metal dome is arranged, the sheet member having insulation properties; and a double-faced adhesive member configured to be arranged between the printed wiring board and the sheet member to attach the sheet member to the printed wiring board, the double-faced adhesive member having the insulation properties and having an opening portion formed in a region where the cutting portion is formed.

4. The switch unit according to claim 3, wherein the plating bar is configured to be formed to connect the first switch contact pattern and the second switch contact pattern.

5. An electronic device including a switch unit comprising:

a printed wiring board on which a first switch contact pattern, a second switch contact pattern, and a cutting portion that cuts a plating bar are formed;

a metal dome configured to be arranged in contact with the first switch contact pattern, the metal dome allowing the first switch contact pattern and the second switch contact pattern to be conduction state by being deformed;

a first sheet member configured to be attached to the printed wiring board via an adhesive, the first sheet member having insulation properties and having a first opening portion formed in a region where the metal dome is arranged and a second opening formed in a region where the cutting portion is formed; and a second sheet member configured to be attached to the first sheet member via the adhesive, the second sheet member having the insulation properties and being attached to the first sheet member to cover the first opening portion and the second opening portion.

6. The electronic device including a switch unit according to claim 5, wherein the plating bar is configured to be formed to connect the first switch contact pattern and the second switch contact pattern.

7. An electronic device including a switch unit comprising:

a printed wiring board on which a first switch contact pattern, a second switch contact pattern, and a cutting portion that cuts a plating bar are formed;

a metal dome configured to be arranged in contact with the first switch contact pattern, the metal dome allowing the first switch contact pattern and the second switch contact pattern to be conduction state by being deformed;

a sheet member configured to be attached to the printed wiring board on which the metal dome is arranged, the sheet member having insulation properties; and a double-faced adhesive member configured to be arranged between the printed wiring board and the sheet member to attach the sheet member to the printed wiring board, the double-faced adhesive member having the insulation properties and having an opening portion formed in a region where the cutting portion is formed.

8. The electronic device including a switch unit according to claim 7, wherein the plating bar is configured to be formed to connect the first switch contact pattern and the second switch contact pattern.

* * * * *